US008137218B2

(12) United States Patent
Leśniewicz

(10) Patent No.: US 8,137,218 B2
(45) Date of Patent: Mar. 20, 2012

(54) TENNIS TRAINING DEVICE

(76) Inventor: Mikołaj Leśniewicz, Śrem (PL)

( * ) Notice: Subject to any disclaimer, the term of this patent is extended or adjusted under 35 U.S.C. 154(b) by 0 days.

(21) Appl. No.: 12/962,678

(22) Filed: Dec. 8, 2010

(65) Prior Publication Data

US 2011/0165970 A1 Jul. 7, 2011

(30) Foreign Application Priority Data

Dec. 8, 2009 (PL) ..... 389827

(51) Int. Cl.
*A63B 69/38* (2006.01)

(52) U.S. Cl. ..... 473/430; 473/459

(58) Field of Classification Search ..... 473/422, 473/423, 427, 429, 430, 451, 459
See application file for complete search history.

(56) References Cited

U.S. PATENT DOCUMENTS

| | | | | | |
|---|---|---|---|---|---|
| 2,818,255 | A * | 12/1957 | Ponza | 473/429 |
| 4,105,203 | A * | 8/1978 | Cho | 473/429 |
| 4,460,172 | A * | 7/1984 | Hogan | 473/426 |
| 4,508,339 | A * | 4/1985 | Llewellyn | 473/429 |
| 4,555,110 | A * | 11/1985 | Hai-Ping | 473/149 |
| 4,699,377 | A * | 10/1987 | Ponza | 473/429 |
| 4,907,801 | A * | 3/1990 | Kopp | 473/423 |
| 5,472,186 | A * | 12/1995 | Paulsen | 473/429 |
| 5,531,438 | A * | 7/1996 | Corley | 473/429 |
| 5,553,848 | A * | 9/1996 | Amron | 473/416 |
| 5,601,286 | A * | 2/1997 | Fierbaugh | 473/429 |
| 5,618,039 | A * | 4/1997 | Tsai et al. | 473/423 |
| 5,788,589 | A * | 8/1998 | Koo et al. | 473/429 |
| 6,390,939 | B1 * | 5/2002 | Palacios | 473/422 |
| 6,458,037 | B1 * | 10/2002 | Dixon, Jr. | 473/219 |
| 7,115,052 | B2 * | 10/2006 | Wardle et al. | 473/459 |
| 7,226,373 | B2 * | 6/2007 | Arenas | 473/417 |
| 8,033,934 | B1 * | 10/2011 | Clancy | 473/430 |
| 2003/0224880 | A1 * | 12/2003 | Hansberry | 473/430 |

* cited by examiner

*Primary Examiner* — Raleigh W. Chiu
(74) *Attorney, Agent, or Firm* — Matthias Scholl, PC; Matthias Scholl

(57) ABSTRACT

A device for practicing tennis strokes that enables a user to develop a correct reflex action and a proper stance while playing tennis, including at least: a supporting structure (1) having a base (1*a*); an arm (3) having a work trajectory; a torsion member (2) including a subunit (12) for adjusting a force acting on the arm (3) and dynamics of movement of the arm (3); a subunit (6) for adjusting the height of the arm; a subunit (8) for setting a deflection of the work trajectory of the arm; a subunit (9) for adjusting the angle of inclination of the torsion member to the vertical axis (B); and a clamping member (4) for non-invasively clamping a tennis ball (5).

14 Claims, 9 Drawing Sheets

TENNIS TRAINING DEVICE

CROSS-REFERENCE TO RELATED APPLICATIONS

Pursuant to 35 U.S.C §119 and the Paris Convention Treaty, this application claims the benefit of Polish Patent Application No. P.389827 filed Dec. 8, 2009, the contents of which are incorporated herein by reference.

BACKGROUND OF THE INVENTION

1. Field of the Invention

The invention relates to a device for practicing tennis strokes that enables a user to develop a correct reflex action and a proper stance while playing tennis.

2. Description of the Related Art

A training device with a ball which is permanently fixed to a flexible supporting element is known from U.S. Pat. Publ. No. 2006/0035729 A1. The operation of such a device is based on fixing a ball on an elastic spring which makes the ball return to a user.

There is also a device, known from U.S. Pat. No. 4,460,172, with a ball permanently fixed to a rigid rotatable arm. After hitting a rigid arm ending with a ball, a return of the ball is forced due to a reaction of the spring.

U.S. Pat. No. 7,115,052 B2 recites a device with a ball permanently fixed to lines ending with fasteners. In this solution, a ball is arranged on two lines ending with a clamping ring. While hit by a player, the ball, mounted on the lines, winds around a vertical element that the lines are fixed to and returns using its centrifugal force.

There is also a known solution disclosed in U.S. Pat. No. 4,095,787 in the form of a device with a ball permanently attached to a long elastic cord connected to a weighted base. Practicing tennis strokes on such devices is based on hitting a ball which is attached to a weighted base. The ball arranged on an elastic cord and hit by a user returns due to rubber elasticity.

In all known solutions of the training devices mentioned above an invasive way of fastening the ball is used. Any interference in a structure of the ball leads to a drop in its inner pressure what significantly affects the elasticity of the ball. The way of a permanent attachment of a ball in devices of such a type, and the angle of incidence of the ball in relation to the tennis racket, in particular, has a significant effect on the reliability of the device. At the same time, the permanent attachment of the ball to a line causes tangling of the line and winding around the handle of the tennis racket.

In the solutions presented above the tennis ball does not return to the user in a controlled way, i.e., in a way which allows the user to repeat the same action in a continuous manner, and furthermore, the movement of the ball is not natural.

SUMMARY OF THE INVENTION

The purpose of this invention is to design a light compact portable training system having an improved reliability, allowing a user to carry out practicing tennis strokes in a more effective way and to provide conditions which are conducive to developing a correct reflex action and a proper stance of the user.

The device for practicing tennis strokes according to the invention comprises: a supporting structure having a base; an arm having a work trajectory; a torsion member comprising a subunit for adjusting a force acting on the arm and dynamics of movement of the arm; a subunit for adjusting the height of the arm; a subunit for setting a deflection of the work trajectory of the arm; a subunit for adjusting the angle of inclination of the torsion member to the vertical axis; and a clamping member for non-invasively clamping a tennis ball; wherein the arm comprises an element having a high elasticity; an end of the arm lying opposite the ball is fastened to the supporting structure via the torsion member; and a connection between the subunit for adjusting the height of the arm, the subunit for setting a deflection of the work trajectory of the arm, and the subunit for adjusting the angle of inclination of the torsion member to the vertical axis, lies between a surface area defined by the base of the supporting structure and the end of the arm lying opposite the ball.

In a class of this embodiment, the supporting structure comprises a cushioning subunit.

In a class of this embodiment, the supporting structure comprises comprises a cushioned tripod frame and a post fastened to the frame.

In a class of this embodiment, the subunit for adjusting the height of the arm comprises a telescoping connection comprising a first element, a second element, and a clamping ring.

In a class of this embodiment, the cushioning element comprises a frame, and the frame comprises three legs; and each of the three legs comprises a crosspiece, an elastic element, and a foot.

In a class of this embodiment, the torsion member comprises inner member immovably fixed to the supporting structure and an outer member rotatably mounted on the inner member.

In a class of this embodiment, the subunit for setting a deflection of the work trajectory of the arm comprises a torsion spring and positioning pins.

In a class of this embodiment, the torsion spring is immovable with respect to the outer member, and the positioning pins are immovable with respect to the supporting structure.

In a class of this embodiment, the subunit for adjusting a force acting on the arm and dynamics of movement of the arm comprises a coil spring; a first end of the coil spring is immovable with respect to the supporting structure; and a second end of the coil spring is immovably connected to the outer member.

In a class of this embodiment, an upper end of the coil spring is suspended on a sleeve which enters a recess in an upper part of the outer member, and both ends of the sleeve are mounted in a knob.

In a class of this embodiment, the elasticity of the arm corresponds to the elasticity of a bar made of carbon fiber.

In a class of this embodiment, the subunit for adjusting the angle of inclination of the torsion member to the vertical axis comprises a first clamping member connecting an upper end of the supporting structure with a lower end of the torsion member.

In a class of this embodiment, the first clamping member forms a connection between a first semicircular part and a second semicircular part via a threaded fastening element.

In a class of this embodiment, the clamping member comprises a cage-like connection between a first flexible connector and the second flexible connector; both ends of the first flexible connector are fastened to the torsion member at its lower and upper ones, respectively; and both ends of the second flexible connector are connected to a nut mounted on a threaded part of a second end of the arm.

The inventive tennis exercise device has a compact and light structure and high reliability. Due to the possibility of adjusting six working parameters of the device it is possible to carry out practicing tennis strokes in a more effective way and to develop a correct reflex action and a proper stance of the user.

BRIEF DESCRIPTION OF THE DRAWINGS

The invention is described hereinbelow with reference to accompanying drawings, in which.

DETAILED DESCRIPTION OF THE INVENTION

Figure 1:
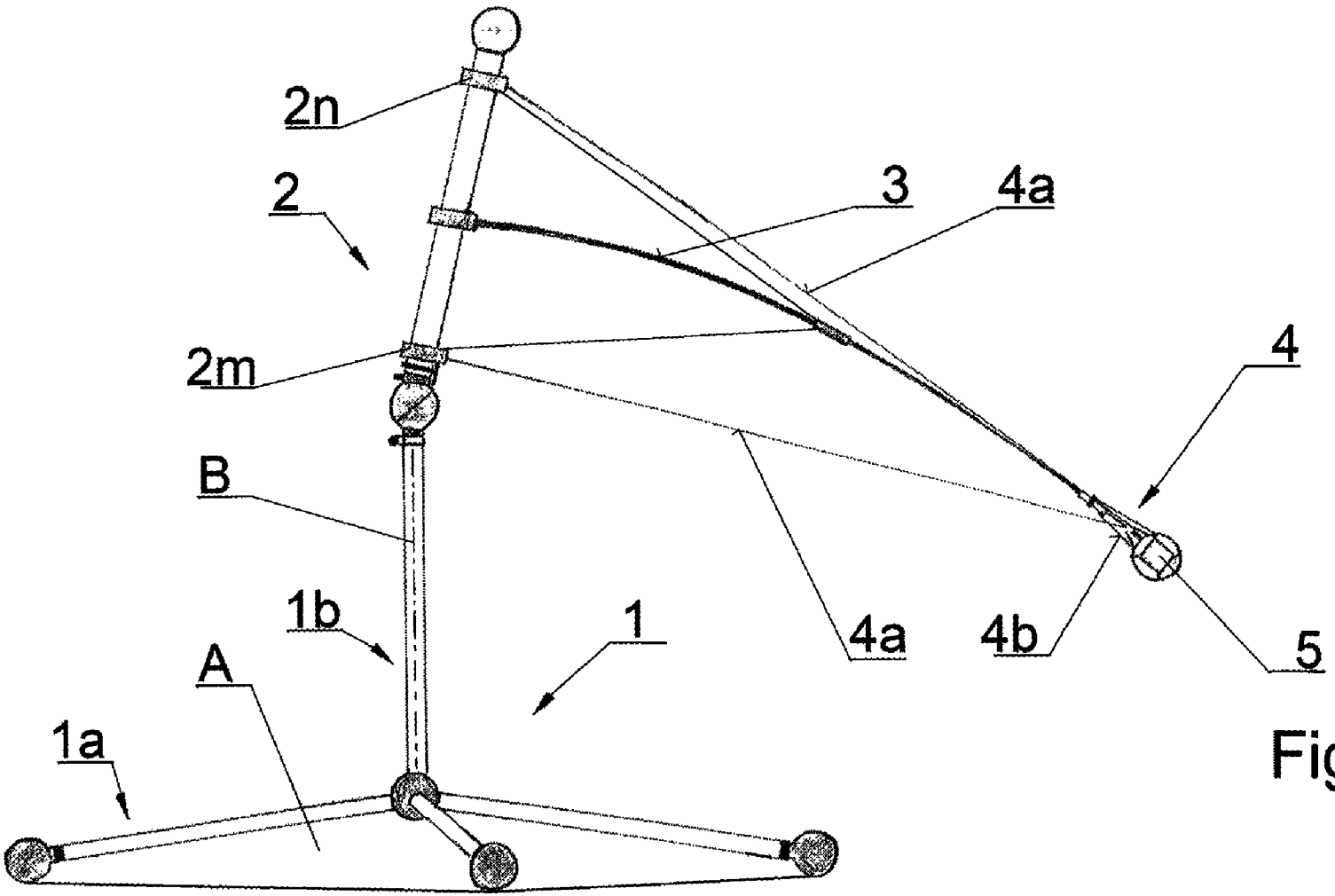
FIG. 1 shows an exemplary embodiment of the device.
Figure 2:
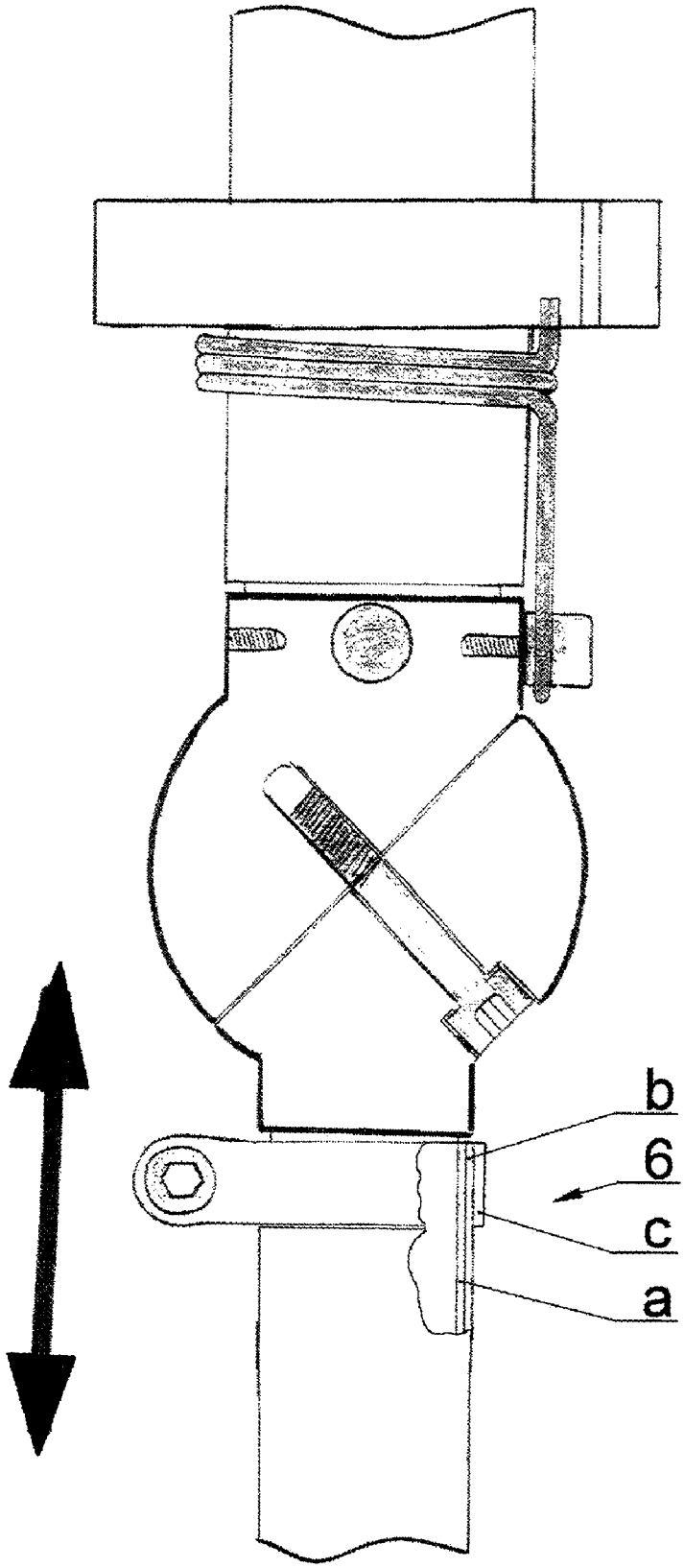
FIG. 2 show an exemplary embodiment of the subunit for adjusting the height position of the arm.
Figure 3:
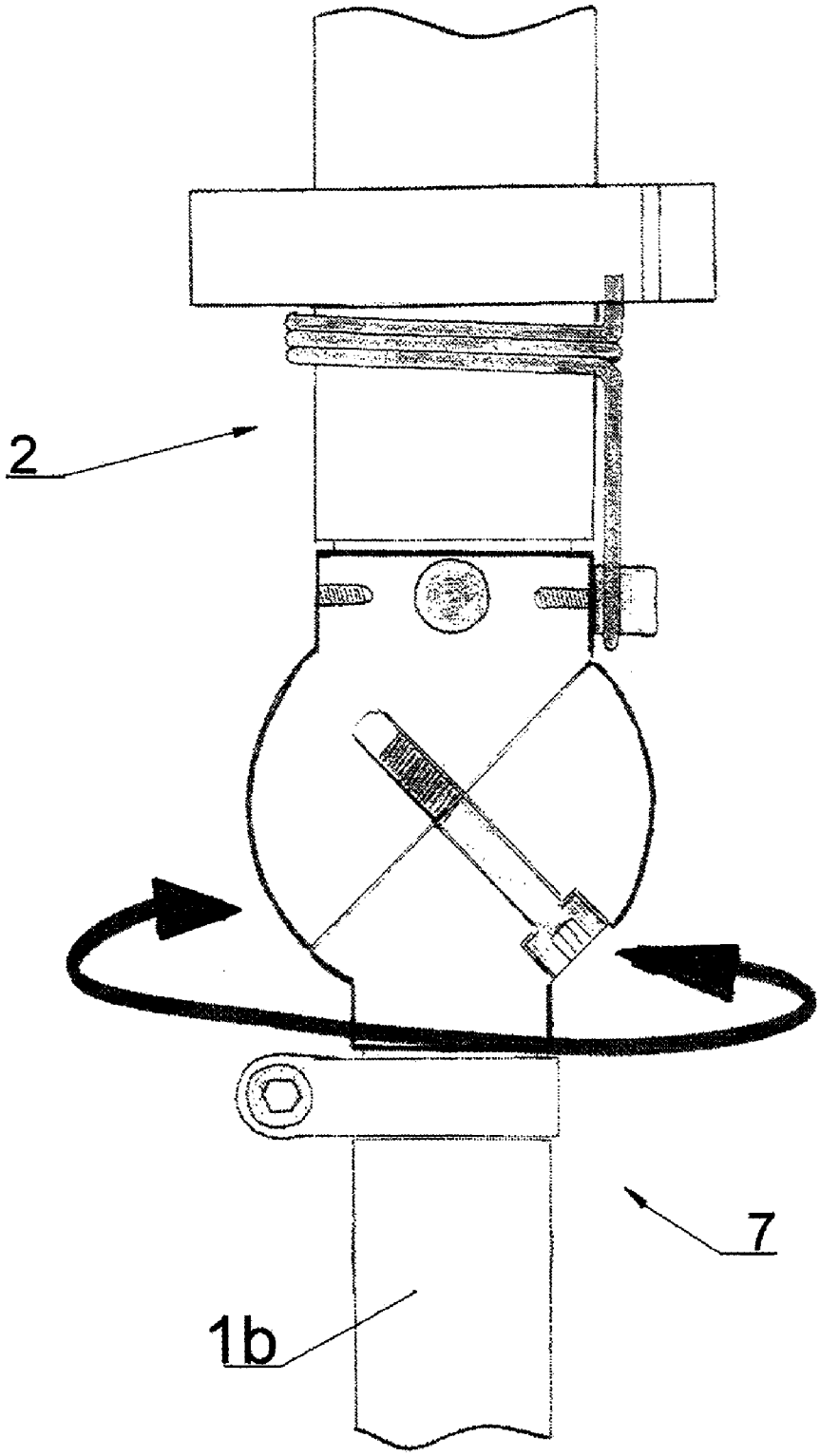
FIG. 3 shows an exemplary embodiment of the subunit for adjusting and setting the angle of rotation.
Figure 4:
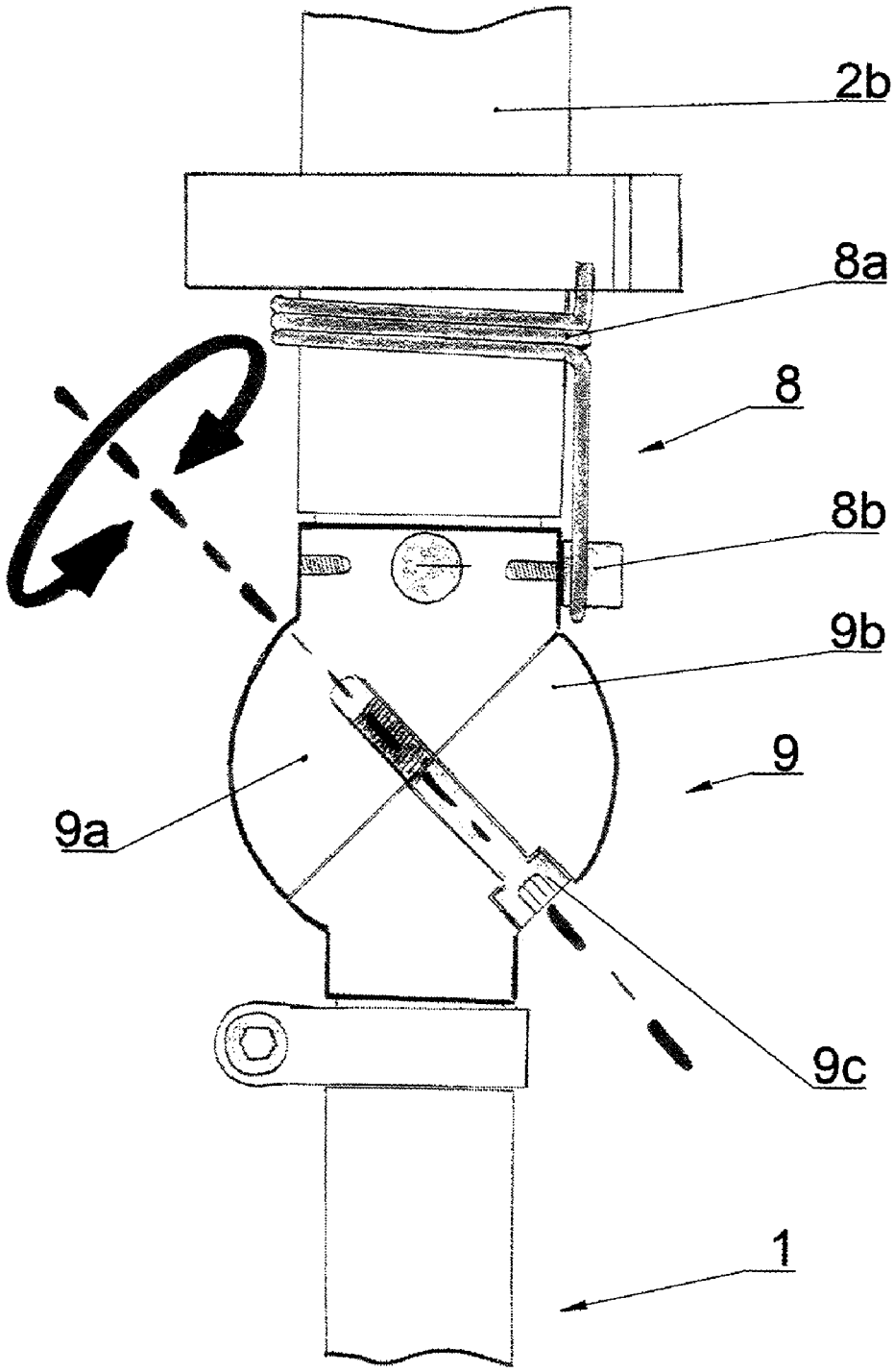
FIG. 4 shows an exemplary embodiment of a connection of the subunit for adjusting the range of deflection of the work trajectory of the arm with the ball and the subunit for adjusting the angle of inclination of the torsion member.
Figure 5:
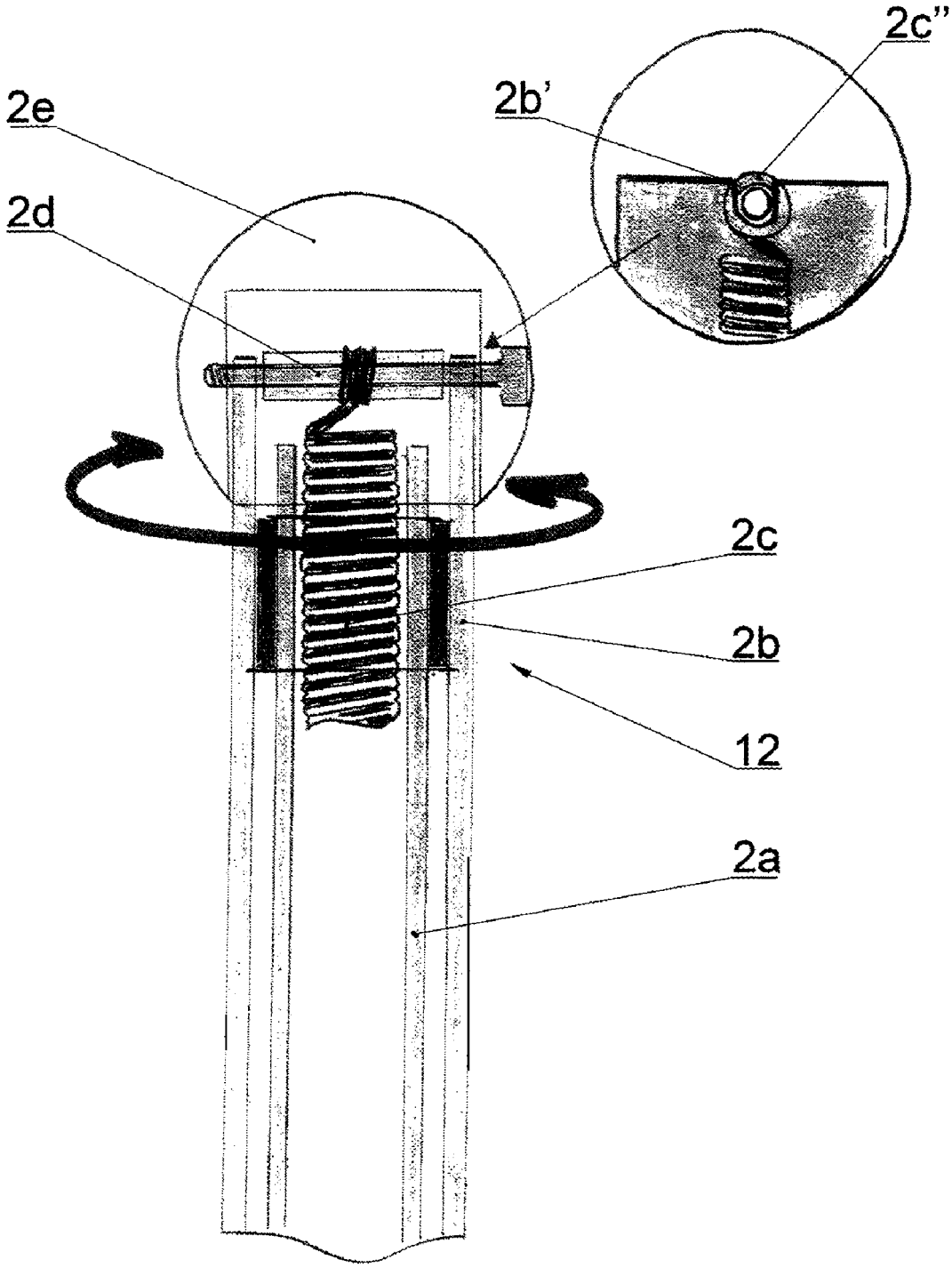
FIG. 5 shows an exemplary embodiment of a section of the upper part of the subunit for adjusting the force and dynamics of movement of the arm.
Figure 6:
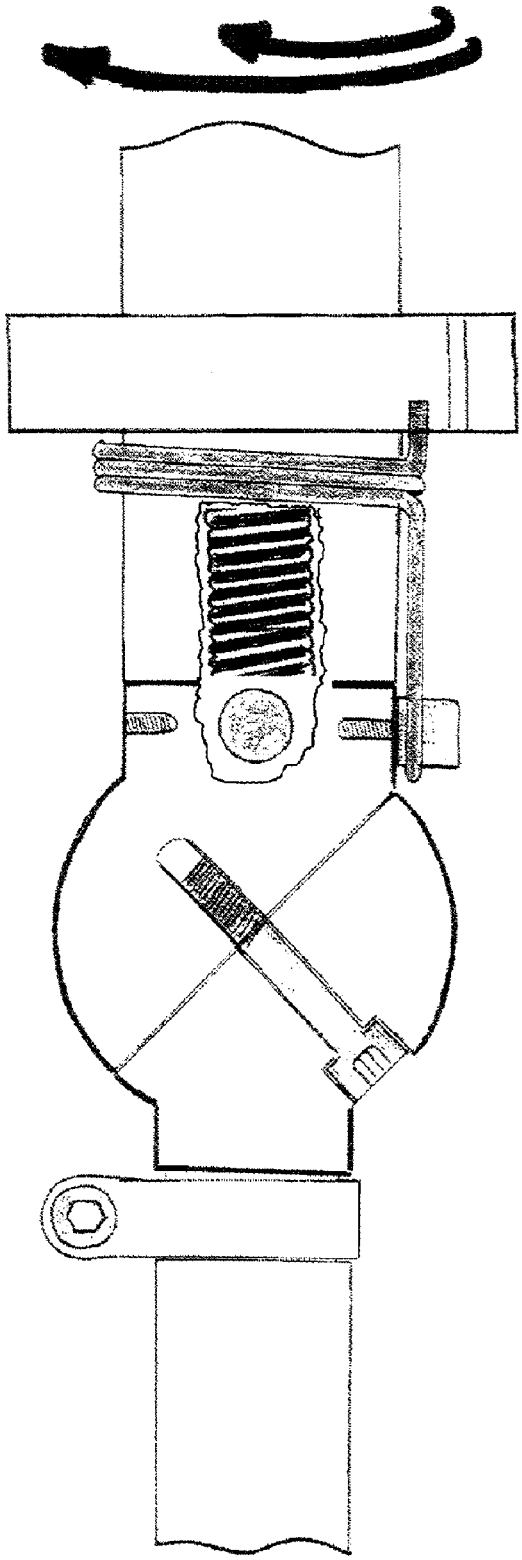
FIG. 6 shows an exemplary embodiment of a section of the lower part of the subunit for adjusting the force and dynamics of movement of the arm.
Figure 7:
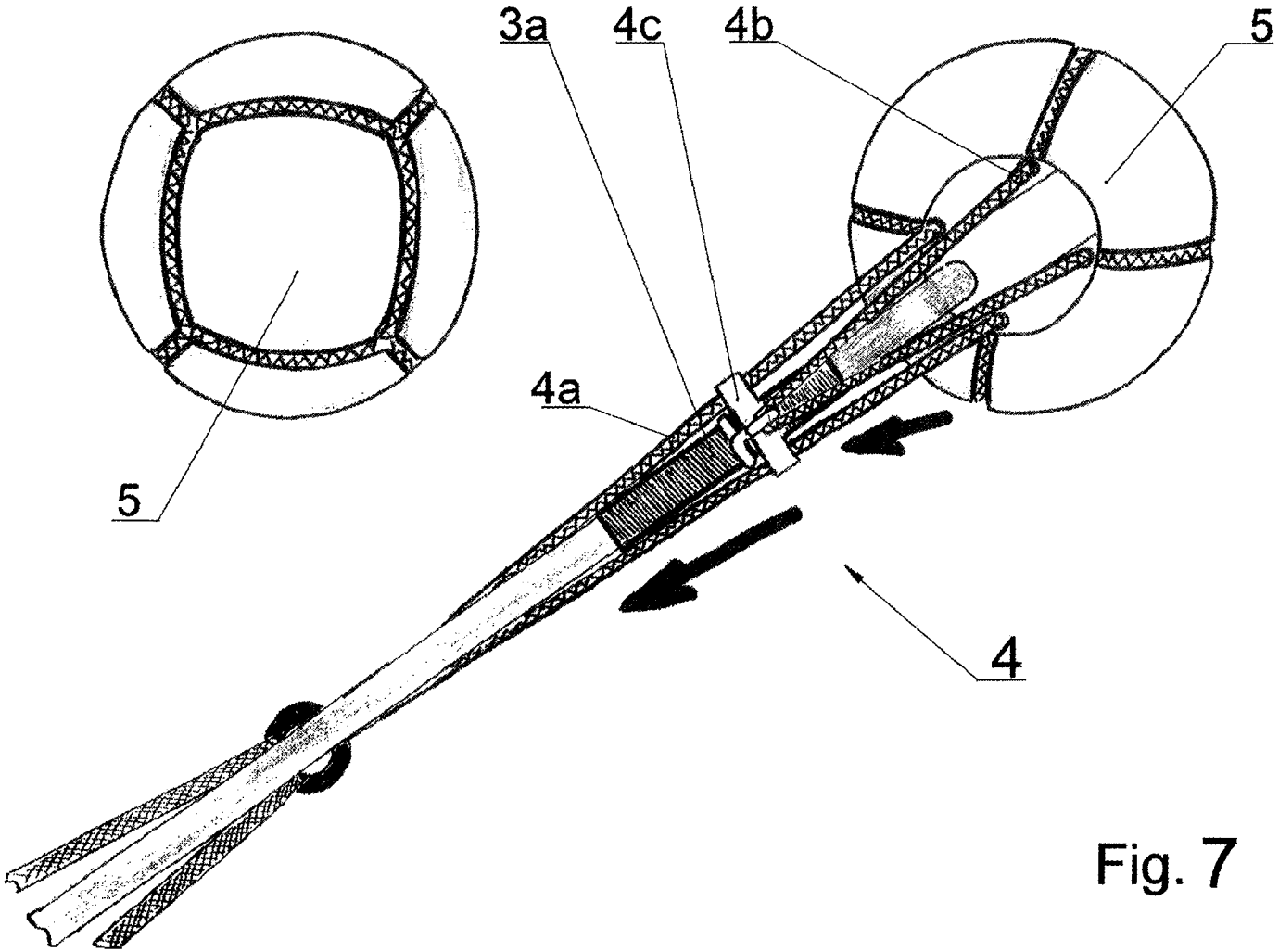
FIG. 7 shows an exemplary embodiment of the clamping subunit.
Figure 8:
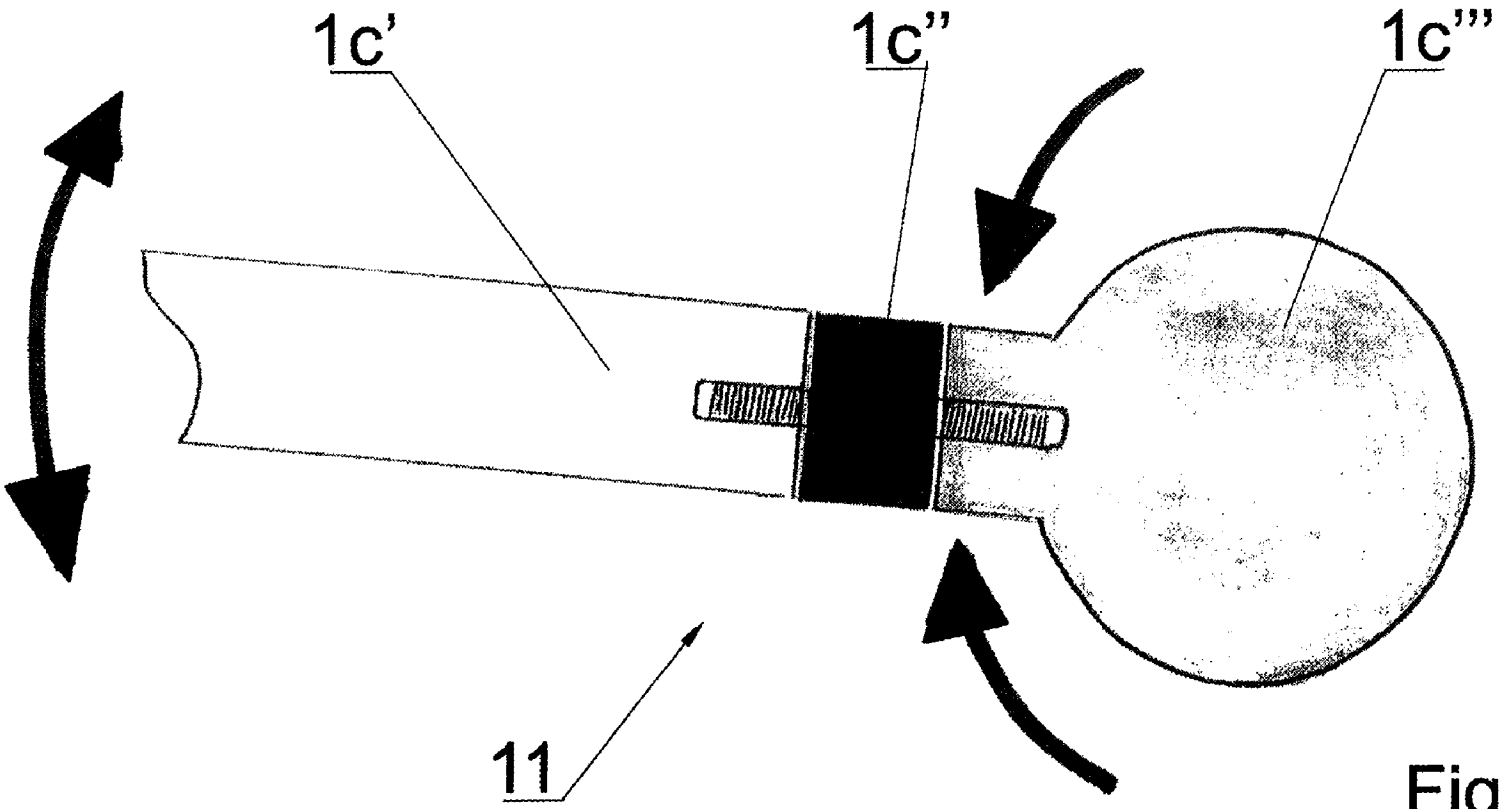
FIG. 8 shows an exemplary embodiment of the cushioning subunit.
Figure 9:
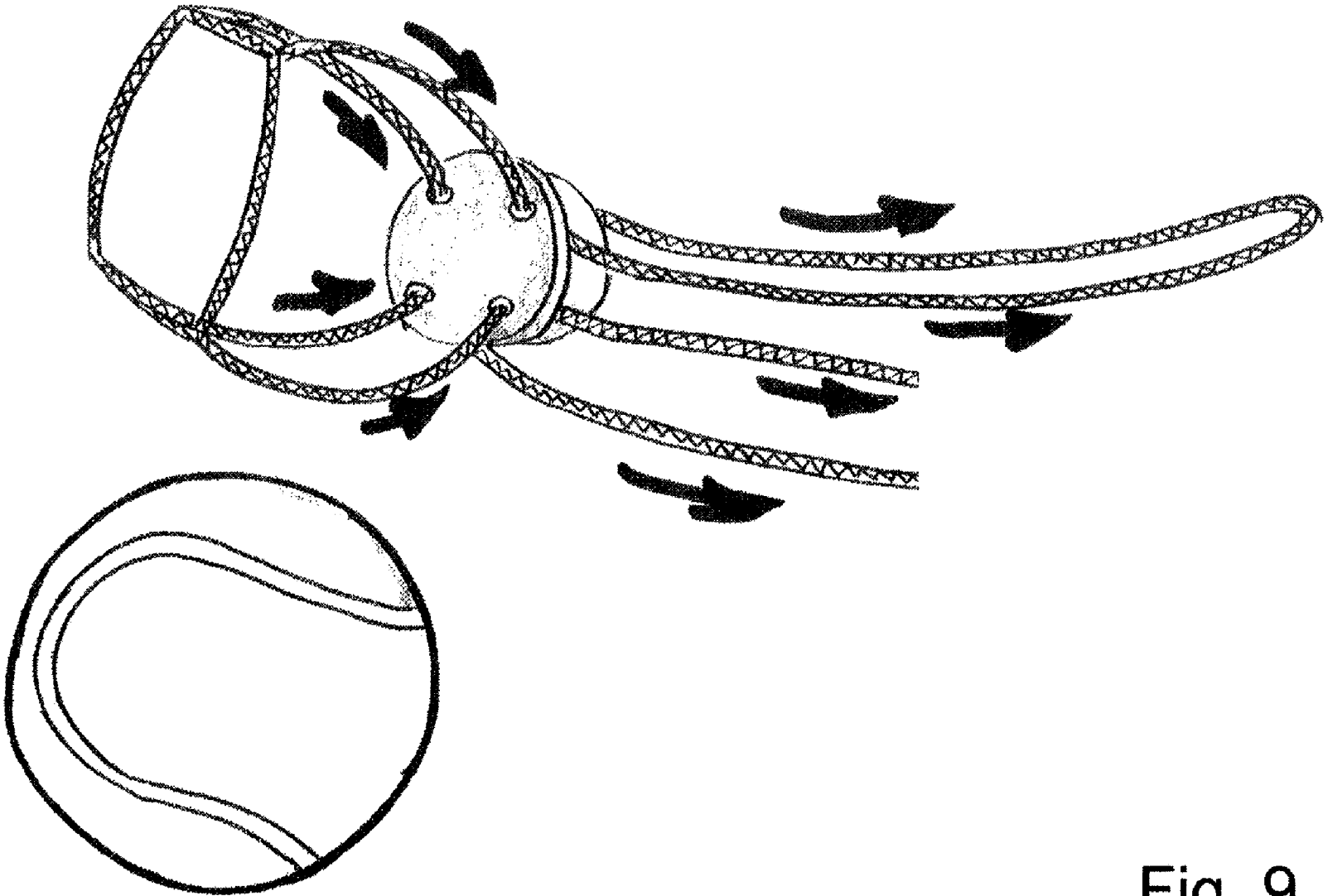
FIG. 9 shows an arrangement of the flexible connectors in the cage-like connection of the clamping subunit.

According to an exemplary embodiment of the invention the device includes a supporting structure 1 in which the torsion member 2 is mounted. The torsion member 2 is connected with the arm 3 having an elasticity corresponding to the one of the bar made of carbon fibre to which by means of the non-invasive clamping member 4 the ball 5 is attached.

The action of the arm 3 absorbs a significant part of the force applied to a ball 5 before it is transformed into a rotary motion of the torsion member 2. Situated between the surface area A determined by the base of the supporting structure 1 and the end of the arm 3 lying opposite the ball 5, is a connection of the subunit for adjusting a height of the arm position 6, the subunit for adjusting and setting the angle of rotation 7 of the arm 3 around the vertical axis B perpendicular to the surface area A determined by the base of the supporting structure 1, the subunit for adjusting the range of deflection of the work trajectory 8 of the arm 3 with the ball 5, and the subunit for adjusting the angle of inclination 9 of the torsion member 2 to the vertical axis B.

The supporting area 1 consists of the tripod cushioned basis 1*a* and the post 1*b* fastened to it. The recognized telescope connection of such components of the post as the element a enclosed by the element b and the clamping ring c is the subunit for adjusting a height of the arm position 3. The clamping ring c protects elements a and b against the relative displacement, and thereby it makes the adjustment of the height of the working part of the device possible and allows to adapt the flight of a tennis ball 5 to the user's height. In order to adjust the height of the position of the arm 3, the clamp of the clamping ring c is released, then the element a within the element b is moved to a set height, and finally the clamp of the clamping ring is tightened.

The cushioning subunit 11 consists of the frame 1*a* which is formed by the arrangement of three legs in which there is a connection of crosspieces 1*c*', elastic elements 1*c*" and feet 1*c*'". The rubber-metal cushions of properly selected parameters of rubber are the elastic elements 1*c*". The elastic elements 1*c*" absorb vibrations and the excessive force of hits, and provide a stability of the device.

The subunit for adjusting and setting the angle of rotation 7 of the arm 3 around the vertical axis B perpendicular to the surface area A defined by the base of the supporting structure 1 is the clamping ring c situated in a place of connection of the post 1*b* and the torsion member 2. The clamping ring c in the subunit for adjusting and setting the angle of rotation 7 makes the adjustment of the position of the device in relation to its own axis possible that allows for positioning the ball 5 within a range suitable for the user. In order to perform this action the clamp of the clamping ring is released c, then the element a within the element b is rotated to the selected position, and finally the clamp of the clamping ring c is tightened.

The subunit which includes the inner member 2*a* immovably connected with the supporting structure 1 and the outer member 2*b* is rotatably mounted on it is the torsion member 2.

The subunit for adjusting the range of deflection of the work path 8 of the arm 3 with the ball 5 setting the range of rotation of the outer member 2 in relation to the supporting structure 1 consists of the torsion spring 8*a* and the positioning pins 8*b*. In the subunit for adjusting the range of deflection of the work trajectory 8 of the arm 3 with the ball 5, the upper end of the torsion spring 8*a* is immovable in relation to the outer member 2*b* and the positioning pins 8*b* are immovable in relation to the supporting structure 1.

The subunit for adjusting the range of deflection of the work trajectory 8 allows to determine the points of the minimum and maximum deflection of the arm 3 and affects the work dynamics of the arm 3. The torsion member includes also the subunit for adjusting the force and the work dynamics of the arm 12. The subunit for adjusting the force and the work dynamics of the arm 12 consists of the coil spring 2*c* mounted inside the inner member 2*a*. The lower end 2*c*' of the spring is immovable in relation to the supporting structure 1, and its upper end 2*c*" is immovable in the upper part of the outer member 2*b* as being suspended on the sleeve 2*d* which enters a recess 2*b*' in the upper part of the outer member 2*b*. The ends of the sleeve are mounted in the knob 2*e*.

The knob 2*e* makes the adjustment of the pretension of the coil spring 2*c* possible. The spring is responsible for the force and the work dynamics of the arm 3 ended with the ball 5. The greater value of the pretension of the coil spring 2*c*, the greater force is needed for hitting the ball 5, and conversely, the ball 5 returns towards the player with the greater force and dynamics.

During the tensioning the coil spring 2*c* there are some additional forces pulling the coil spring 2*c* "towards itself" that help the spring to seize in the recess 2*b* of the upper part of the outer member 2*b* in a controlled smooth and reliable way, while turning it by an angle 180°, for example.

At any time in order to take the ends of the sleeve 2*d* out of the recess 2*b*', and to increase or to decrease the tension of the coil spring 2*c*, it is sufficient to pull the knob 2*e* slightly up.

The first clamping subunit which connects the upper end of the supporting structure 1 with the lower end of the torsion member 2 is the subunit for adjusting the angle of inclination 9 of the torsion member to the vertical axis B. The first clamping subunit being the subunit for adjusting the angle of inclination 9 forms the connection between the first semicircular part 9*a* and the second semicircular one 9*b* executed by means of the threaded fastening element 9*c*.

The possibility of adjustment of the inclination angle of the twist working element 2 to the vertical axis B allows for changing the angle of the flight of the ball 5. In order to adjust the angle the threaded fastening element 9*c* is loosened; next, the selected angle is set and by means of the threaded fastening element 9*c*, and the first semicircular part 9*a* is pressed to the second semicircular part 9*b*.

The non-invasive clamping member 4 consists of the cage-like connection of the first flexible connector 4*a* and the second flexible connector 4*b*, while the ends of the first flexible connector 4*a* pass through the passage elements 2*m* and 2*n* of the torsion member 2 next to its ends, whereas the ends of the second flexible element 4*b* are connected with the nut mounted on the threaded part of the end of the arm 3*a*. The tension of the flexible connector 4*a* clamps the cage with the ball 5 under the influence of the force which decompresses the properly tensioned bar of coal fibre i.e. the arm 3. The second flexible connector 4*b* clamps the cage with the ball 5 under the influence of the force which is adjusted by means of the nut 4*c* moving on the threaded part of the end of the arm 3*a*.

The supporting structure of the device is made of light aluminium alloys. The other parts of the device are made of the latest ultra light construction materials such as ertalon, erthoryte and teflon that makes that the device is safe and can be easily moved from place to place.

This invention is not to be limited to the specific embodiments disclosed herein and modifications for various applications and other embodiments are intended to be included within the scope of the appended claims. While this invention has been described in connection with particular examples thereof, the true scope of the invention should not be so limited since other modifications will become apparent to the skilled practitioner upon a study of the drawings, specification, and following claims.

All publications and patent applications mentioned in this specification are indicative of the level of skill of those skilled in the art to which this invention pertains. All publications and patent applications mentioned in this specification are herein incorporated by reference to the same extent as if each individual publication or patent application mentioned in this specification was specifically and individually indicated to be incorporated by reference.

The invention claimed is:

1. A device for practicing tennis strokes, comprising:

a supporting structure (1) having a base (1*a*);

an arm (3) having a work trajectory;

a torsion member (2) comprising a subunit (12) for adjusting a force acting on the arm (3) and dynamics of movement of the arm (3);

a subunit (6) for adjusting the height of the arm;

a subunit (8) for setting a deflection of the work trajectory of the arm;

a subunit (9) for adjusting the angle of inclination of the torsion member to the vertical axis (B); and a clamping member (4) for non-invasively clamping a tennis ball (5); wherein said arm (3) comprises an element having a high elasticity;

an end (3*b*) of said arm (3) lying opposite the ball (5) is fastened to said supporting structure (1) via said torsion member (2); and a connection (13) between said subunit (6) for adjusting the height of the arm, said subunit (8) for setting a deflection of the work trajectory of the arm, and said subunit (9) for adjusting the angle of inclination of the torsion member to the vertical axis (B), lies between a surface area (A) defined by said base (1*a*) of said supporting structure (1) and said end (3*b*) of said arm (3) lying opposite the ball (5).

2. The device of claim 1, wherein said supporting structure (1) comprises a cushioning subunit (11).

3. The device of claim 1, wherein said supporting structure (1) comprises a cushioned tripod frame (1*a*) and a post (1*b*) fastened to said frame (1*a*).

4. The device of claim 3, wherein said subunit (6) for adjusting the height of the arm comprises a telescoping connection comprising a first element (a), a second element (b), and a clamping ring (c).

5. The device of claim 1, wherein said cushioning element (11) comprises a frame (1*a*), and said frame (1*a*) comprises three legs; and each of said three legs comprises a crosspiece (1*c*'), an elastic element (1*c*''), and a foot (1*c*''').

6. The device of claim 1, wherein said torsion member (2) comprises inner member (2*a*) immovably fixed to said supporting structure (1) and an outer member (2*b*) rotatably mounted on said inner member (2*a*).

7. The device of claim 1, wherein said subunit (8) for setting a deflection of the work trajectory of the arm comprises a torsion spring (8*a*) and positioning pins (8*b*).

8. The device of claim 7, wherein said torsion spring (8*a*) is immovable with respect to said outer member (2*b*), and said positioning pins (8*b*) are immovable with respect to said supporting structure (1).

9. The device of claim 1, wherein said subunit (12) for adjusting a force acting on the arm (3) and dynamics of movement of the arm (3) comprises a coil spring (2*c*); a first end of said coil spring (2*c*) is immovable with respect to said supporting structure (1); and a second end of said coil spring (2*c*) is immovably connected to said outer member (2*b*).

10. The device of claim 9, wherein an upper end (2*c*'') of said coil spring (2*c*) is suspended on a sleeve which enters a recess (2*b*') in an upper part of said outer member (2*b*), and both ends of said sleeve are mounted in a knob (2*e*).

11. The device of claim 1, wherein the elasticity of said arm (3) corresponds to the elasticity of a bar made of carbon fiber.

12. The device of claim 1, wherein said subunit (9) for adjusting the angle of inclination of the torsion member to the vertical axis (B) comprises a first clamping member connecting an upper end of said supporting structure (1) with a lower end of said torsion member (2).

13. The device of claim 12, wherein said first clamping member forms a connection between a first semicircular part (9*a*) and a second semicircular part (9*b*) via a threaded fastening element (9*c*).

14. The device of claim 1, wherein said clamping member (4) comprises a cage-like connection between a first flexible connector (4*a*) and the second flexible connector (4*b*); both ends of said first flexible connector (4*a*) are fastened to said torsion member (2) at its lower and upper ones, respectively; and both ends of said second flexible connector (4*b*) are connected to a nut (4*a*) mounted on a threaded part of a second end (3*a*) of said arm (3).

* * * * *